US005267557A

United States Patent [19]

Her-Mou

[11] Patent Number: 5,267,557

[45] Date of Patent: Dec. 7, 1993

[54] NOSE MASK WITH A FILTERING DEVICE

[76] Inventor: Lin Her-Mou, P.O. Box 82-144, Taipei, Taiwan

[21] Appl. No.: 931,024

[22] Filed: Aug. 17, 1992

[51] Int. Cl.[5] ..... A62B 18/02

[52] U.S. Cl. ..... 128/206.21; 128/206.27; 128/207.13

[58] Field of Search ..... 128/200.27, 200.28, 128/206.17, 206.18, 207.13, 206.21, 206.27

[56] References Cited

U.S. PATENT DOCUMENTS

| | | | |
|---|---|---|---|
| 1,176,886 | 3/1916 | Ermold | 128/207.13 |
| 1,192,186 | 7/1916 | Greene | 128/207.13 |
| 1,206,045 | 11/1916 | Smith | 128/207.13 |
| 1,288,647 | 12/1918 | Miller | 128/207.13 |
| 1,632,449 | 6/1927 | McKesson | 128/207.13 |
| 2,332,662 | 10/1943 | Nathanson | 128/200.27 |
| 3,683,907 | 8/1972 | Cotabish | 128/200.28 |
| 4,846,170 | 7/1989 | McAnalley et al. | 128/207.13 |
| 5,046,492 | 9/1991 | Stackhouse et al. | 128/200.27 |
| 5,104,430 | 4/1992 | Her-Mou | 128/206.17 |

FOREIGN PATENT DOCUMENTS

| | | | |
|---|---|---|---|
| 27600 | of 1903 | United Kingdom | 128/207.13 |

*Primary Examiner*—Edgar S. Burr
*Assistant Examiner*—Aaron J. Lewis
*Attorney, Agent, or Firm*—Alfred Lei

[57] ABSTRACT

This invention relates to a nose mask with a filtering device and in particular to one including a resilient clamp adapted to be worn on a head of an user, a mask adapted to a nose of an user and having an inlet pipe and an exhaust pipe, and a filter connected with one side of the resilient clamp and being driven by a dc motor. The filter is provided with an outlet connected with the inlet pipe of the mask via a flexible pipe and an inlet through which air may be sucked in from outside whereby when in use, air will be filtered and transmitted to the mask through the flexible pipe and the inlet pipe thereby enabling the user to inhale cleaned air while air exhaled by the user will be exhausted out of the exhaust pipe of the mask.

1 Claim, 11 Drawing Sheets

NOSE MASK WITH A FILTERING DEVICE

BACKGROUND OF THE INVENTION

It is found that the conventional mask simply utilizes a visor to separate the face of an user from the outside and enables air to flow in the nose of the user from the lower side of the visor. However, such mask has no filtering effect and cannot keep the user from being hurted by the polluter air. As to the cloth mask, it will obstruct the user from inhaling and exhaling normally thus making the user a slight oxygenless sign. In addition, all masks on the market is unfit for use with one who has to use one's mouth to blow air through a whistle or the like.

Therefore, it is an object of the present invention to provide a nose mask with a filtering device which may obviate and mitigate the above-mentioned drawbacks.

SUMMARY OF THE INVENTION

This invention relates to a nose mask with a filtering device.

It is the primary object of the present invention to provide a nose mask with a filtering device which may effectively clean the air from outside.

It is another object of the present invention to provide a nose mask with a filtering device which may enable the user to inhale and exhale normally.

It is still another object of the present invention to provide a nose mask with a filtering device which is simple in construction.

It is still another object of the present invention to provide a nose mask with a filtering device which is economic to produce.

It is a further object of the present invention to provide a nose mask with a filtering device which has industrial value.

Other objects and merits and a fuller understanding of the present invention will be obtained by those having ordinary skill in the art when the following detailed description of the preferred embodiment is read in conjunction with the accompanying drawings.

BRIEF DESCRIPTION OF THE DRAWINGS

FIGS. 8 and 8A show the structure of the coupler;

FIGS. 9 and 9A show the structure of the retainer;

DETAILED DESCRIPTION OF THE PREFERRED EMBODIMENT

Figure 1:
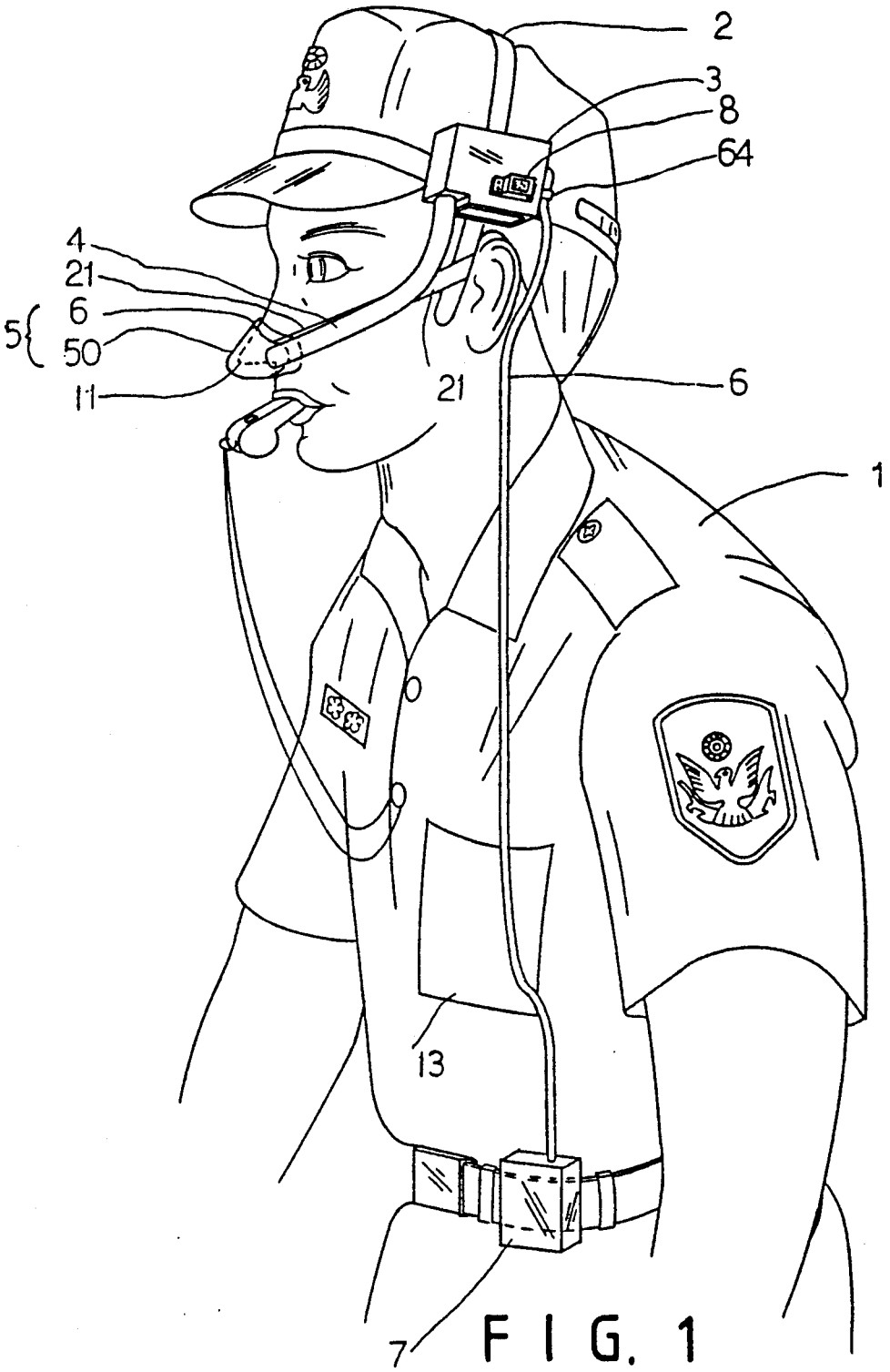
FIG. 1 is a perspective view showing an application of the present invention.
Figure 2:
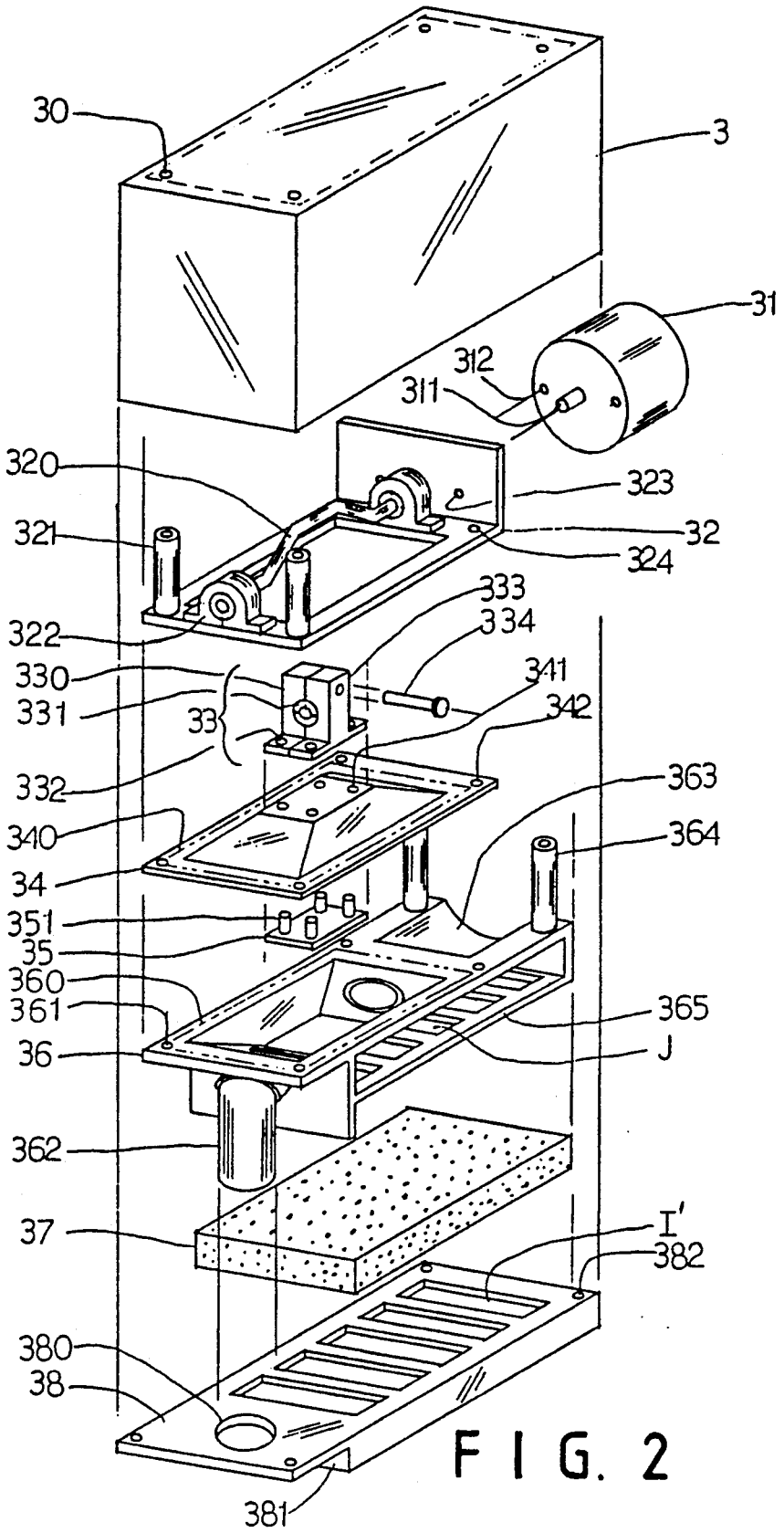
FIG. 2 is an exploded view of the filter.
Figure 3:
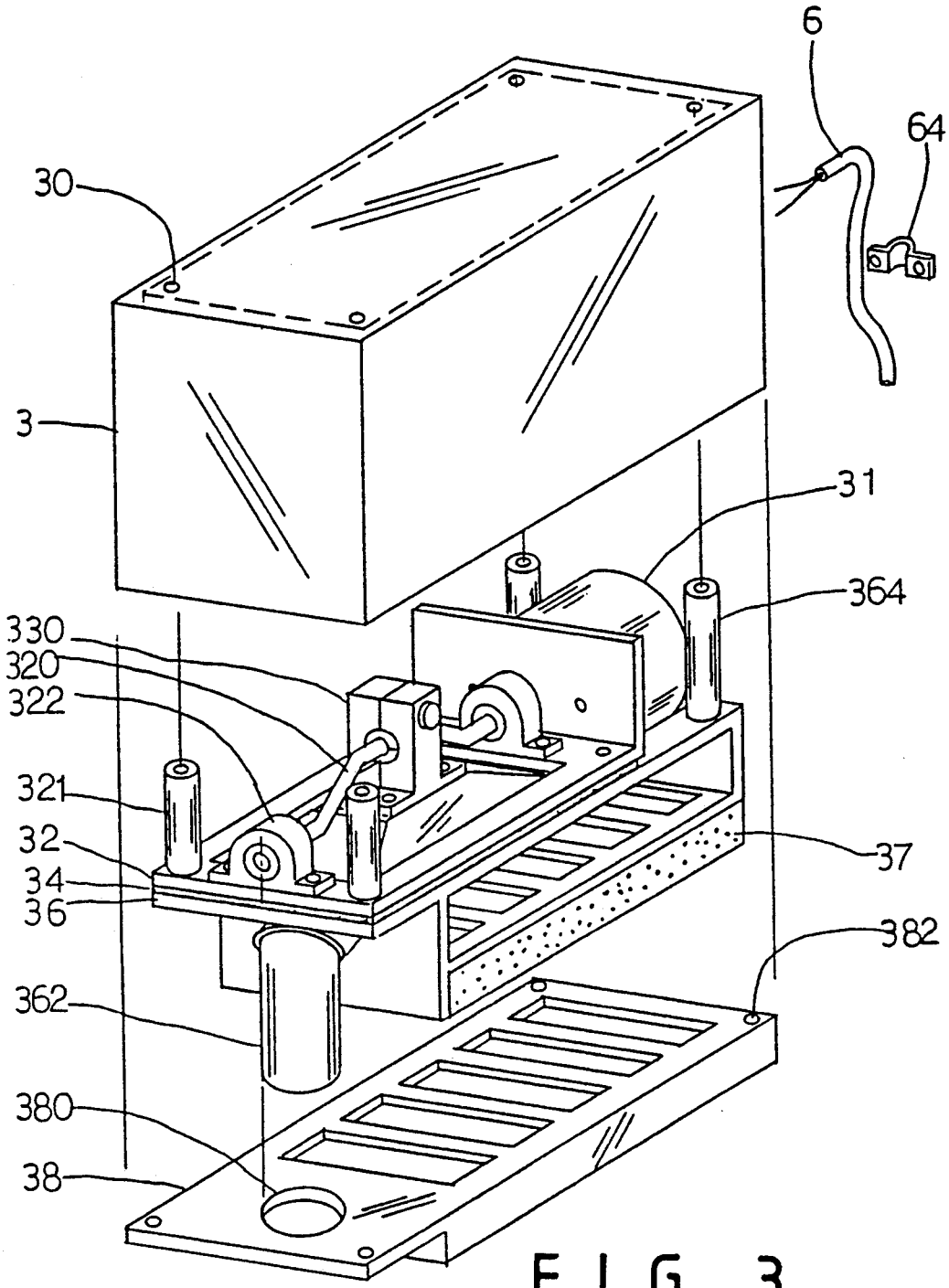
FIG. 3 shows an assembly of the filter.
Figure 4:
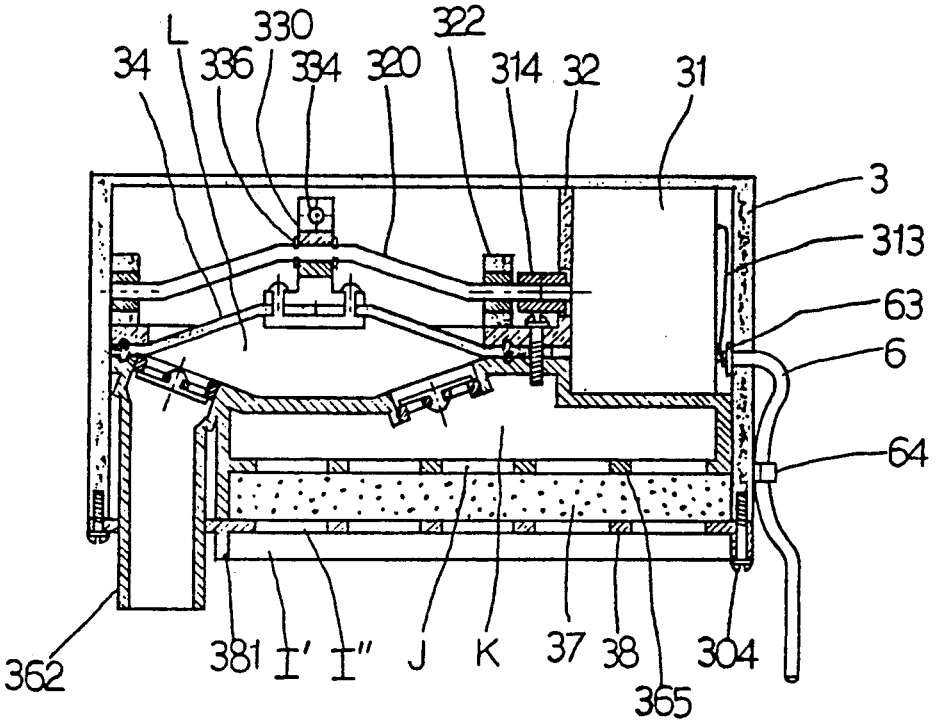
FIG. 4 is a sectional view of the filter.
Figure 5:
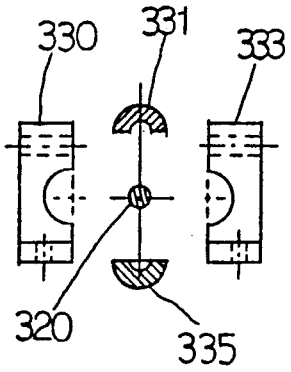
FIG. 5 is an exploded view of the crank.
Figure 6:
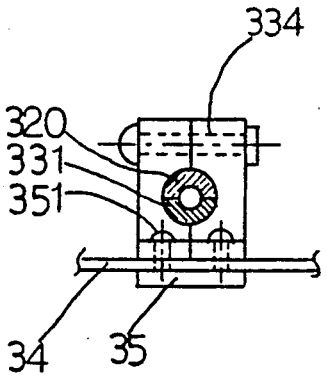
FIG. 6 is front view of the crank.
Figure 7:
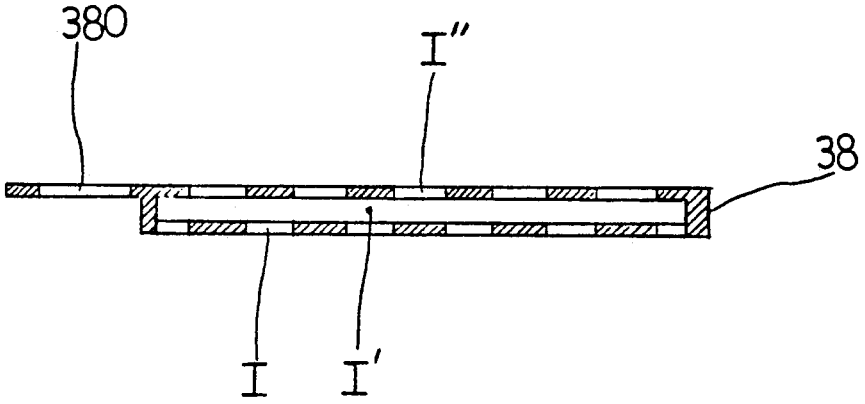
FIG. 7 shows another preferred lower cover.
Figures 8A, 9:
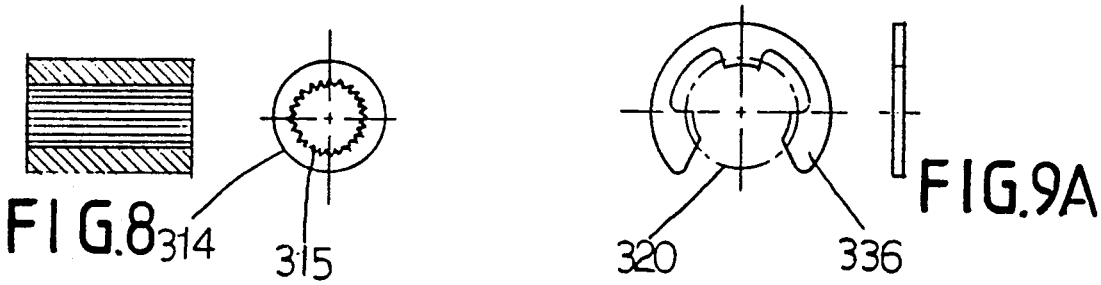
Figure 10:
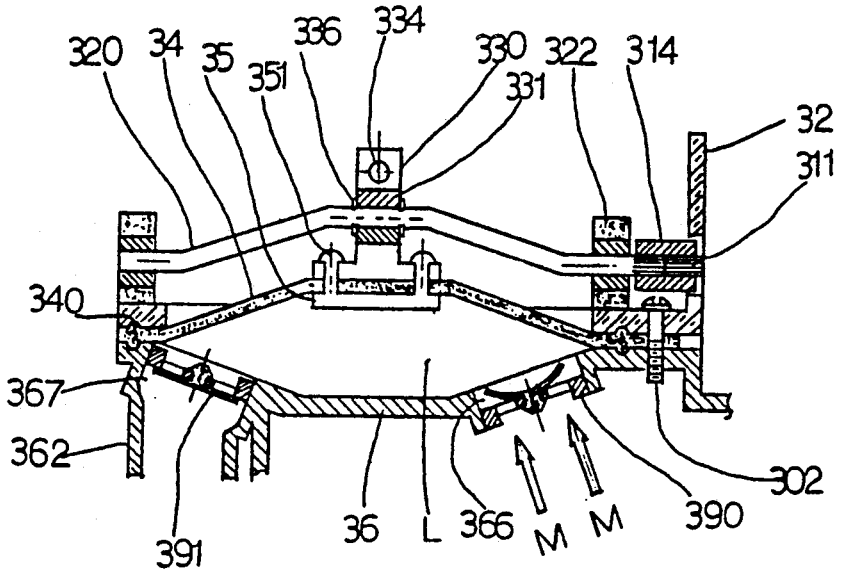
FIGS. 10 and 11 show the volume change of the exhaust chamber L of the filter.
Figure 11:
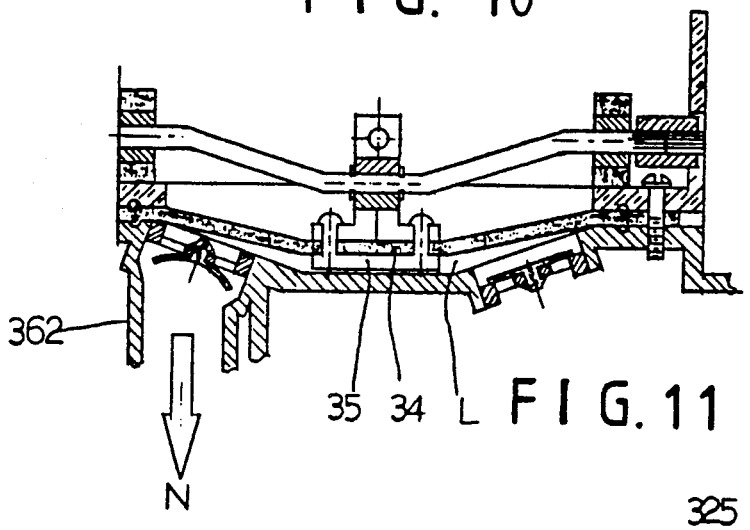
Figure 12:
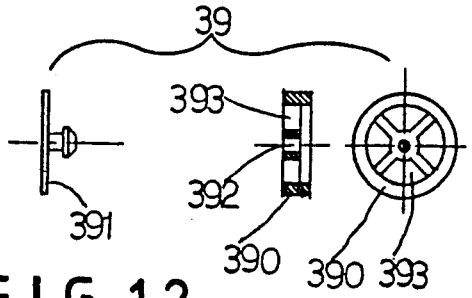
FIG. 12 is an exploded view of the one-way exhaust valve.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 13:
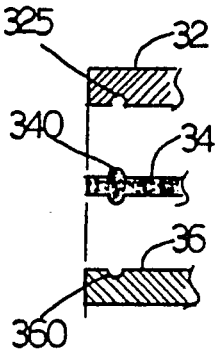
FIG. 13 shows the engagement between the upper fixing plate, the lower fixing plate and the diaphram.
Figure 14:
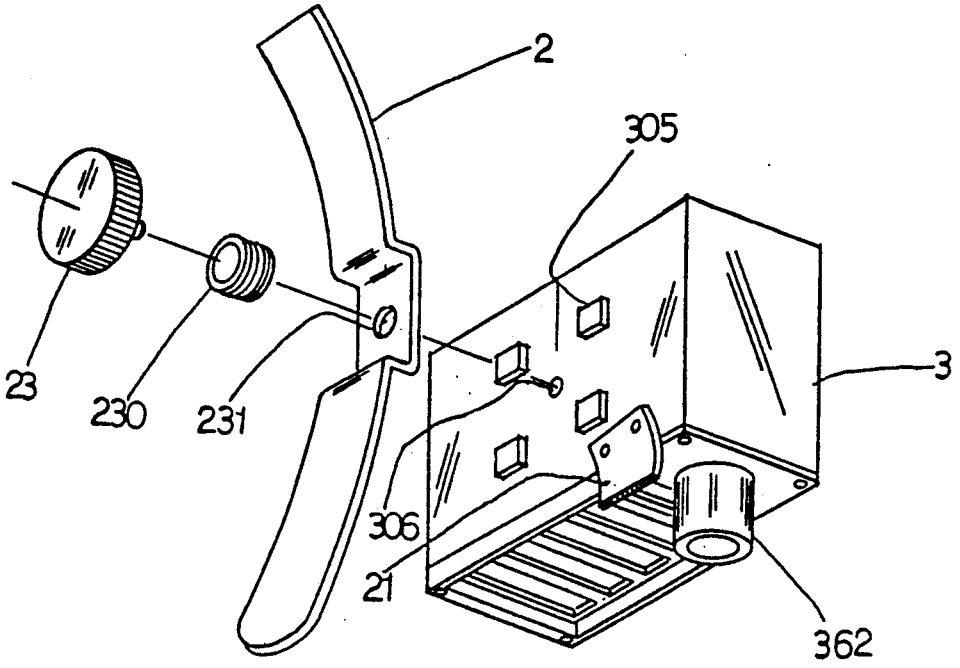
FIG. 14 shows the way to engage the resilient clip with the filter.
Figure 15:
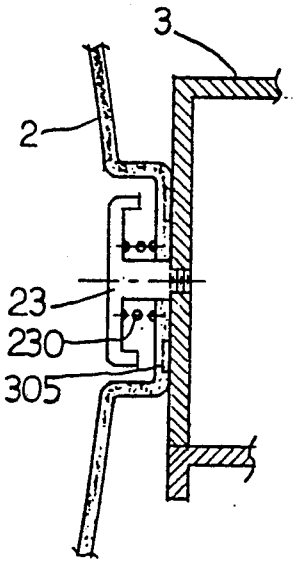
FIGS. 15, 16 and 17 show the working principle of the resilient clip.
Figure 16:
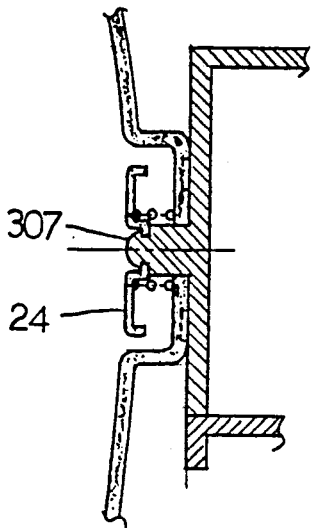
Figure 17:
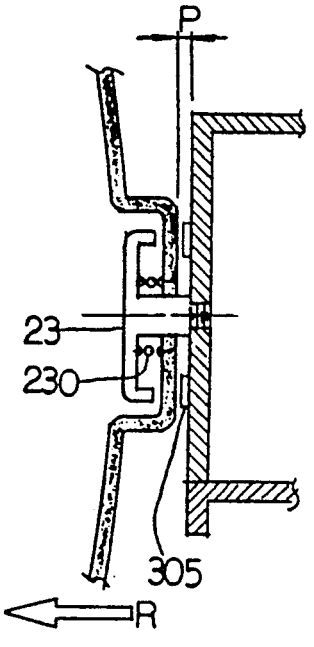
Figure 18:
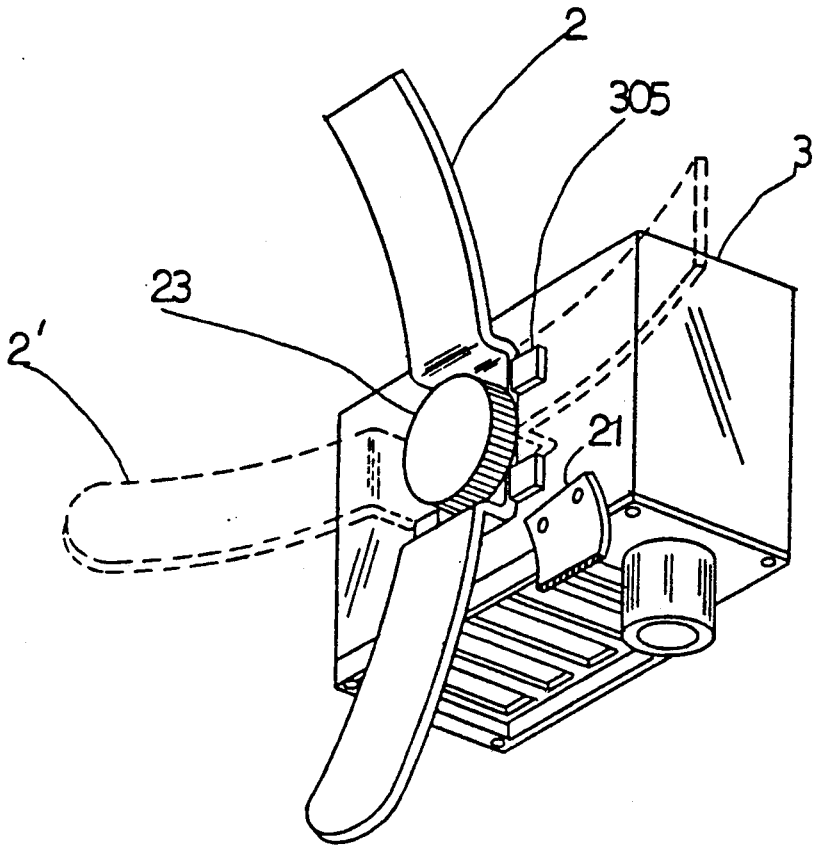
FIG. 18 shows how the resilient clip is turned through an angle of 180 degrees.
Figure 28:
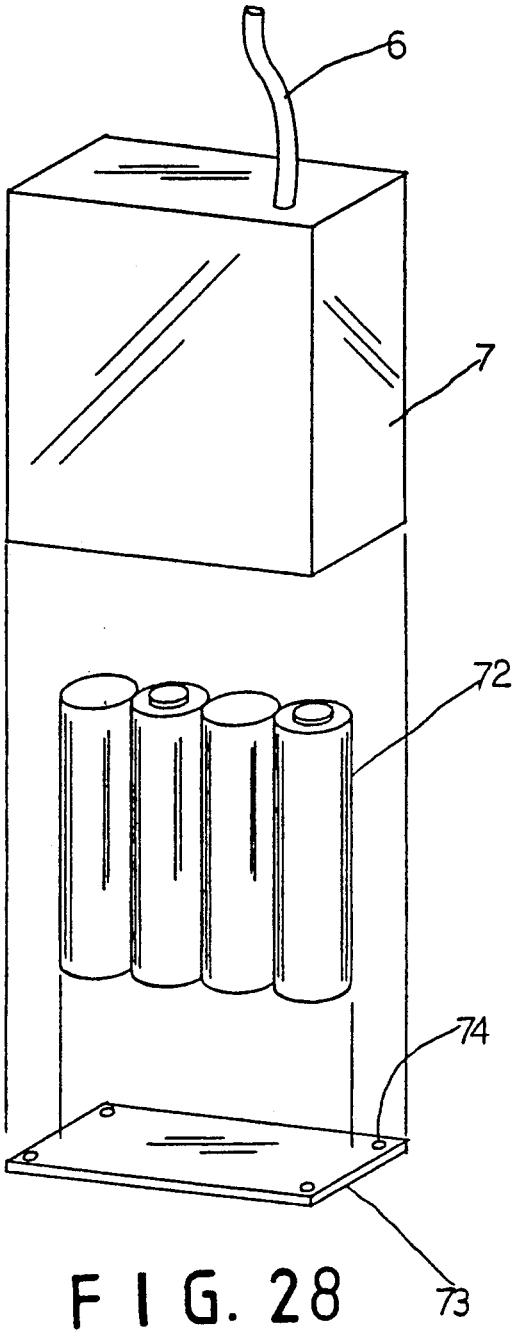
FIG. 28 is an exploded view of the battery case.
Figure 29:
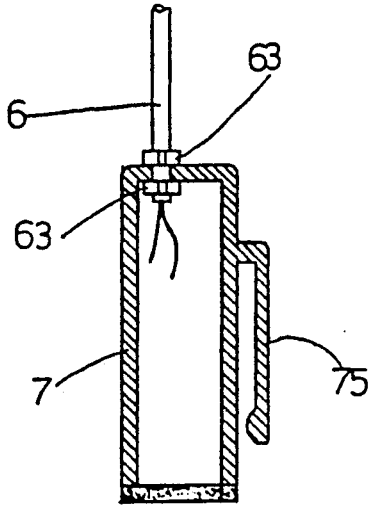
FIG. 29 is a sectional side view of the battery case.

With reference to the drawings and in particular to FIG. 1 thereof, the nose mask with an air filtering device according to the present invention mainly comprises a resilient clip 2, a filter 3, a flexible pipe 4 and a mask 5. Looking now at FIGS. 2 through 13, the filter 3 includes a housing 3, a crank shaft 320, an upper fixing plate 32, a DC motor 31, a crank arm 33, a rubber diaphragm 34, a lower fixing plate 36, a filtering layer 37, and a lower cover 38. The crank arm 33 is enclosed by an upper bushing 331 and a lower bushing 335 which are in turn enclosed by a left clamp 330 and a right clamp 333. Then, the crank arm 33 is fixedly mounted on a fixing plate 35 by rivets 334 so that the crank shaft 320 is firmly kept in place by the crank arm 33. The crank shaft 320 is engaged with a E-shaped retainer 336 so that the crank arm 33 is firmly kept in place by the crank shaft 320. The other end of the crank shaft 320 is connected to the axle 311 of the motor 31 via a coupler 314. The rubber diaphragm 34 is fixedly mounted on the crank arm 33 by four rivets 351 of the fixing plate 35. The motor 31 is driven by dry batteries (see FIG. 28) hence moving the diaphragm 34 upwards and downwards. Further, the upper fixing plate 32, the lower fixing plate 36 and the partition plate 24 are tightly connected together through the engagement between the recesses 325, 360 and the protrusion 340 (see FIG. 13). When the chamber L becomes larger, the one-way exhaust valve 39 at the right will be pushed open by the air M through the filtering layer 37. On the other hand, the one-way exhaust valve 39 at the left will be kept closed. As the crank arm 33 is lowered, the chamber L will become smaller and the one-way exhaust valve 39 at the right will be closed thereby causing the air to push open the one-way exhaust valve 39 at the left and to exhaust through an outlet pipe 362. Then, the air flows through the flexible pipe 4 into the mask 5 so that the user may take clean air into his lung.

The lower cover 38 is provided with an extended side 381 on which there are a plurality of slots I thereby preventing polluted air from passing therethrough.

Figure 19:
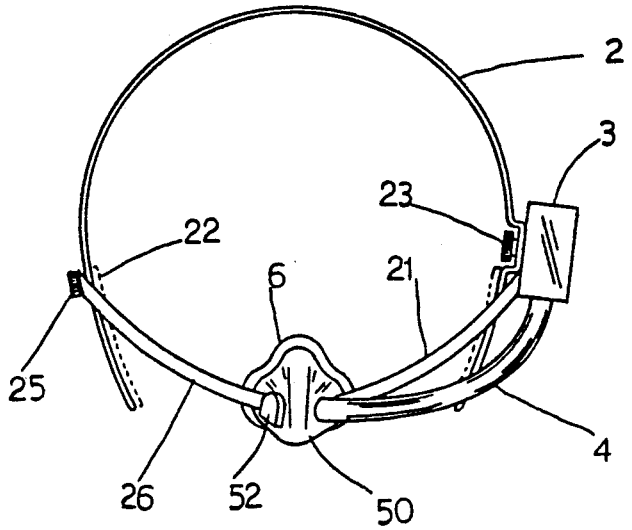
FIG. 19 is a front view of the present invention.
Figure 21:
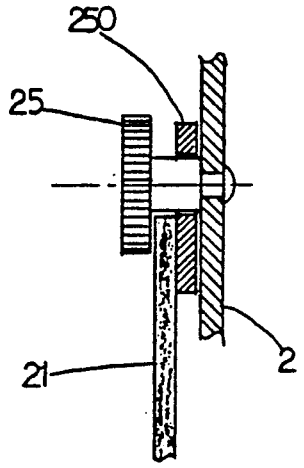
FIG. 21 is a sectional side view showing the fixation of the elastic band 26.
Figure 20:
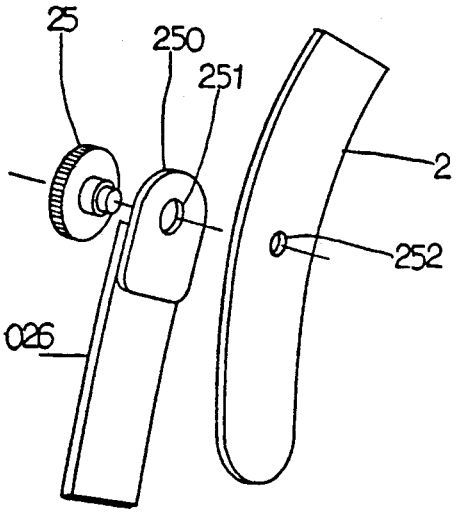
FIG. 20 shows the way to fix the elastic band 26 in position.
Figure 22:
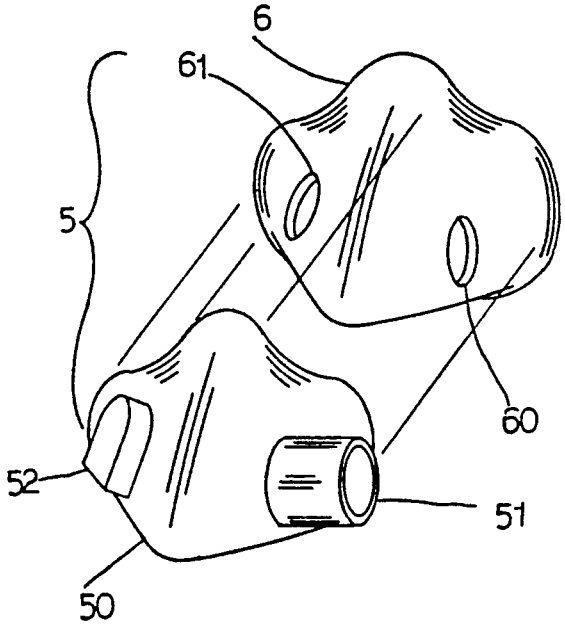
FIG. 22 is an exploded view of the mask.
Figure 23:
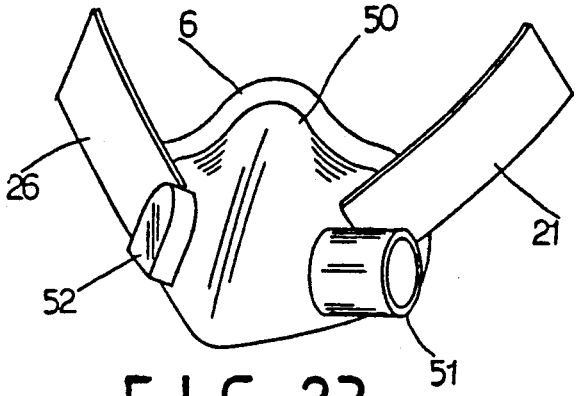
FIG. 23 is a perspective view of the mask.
Figure 25:
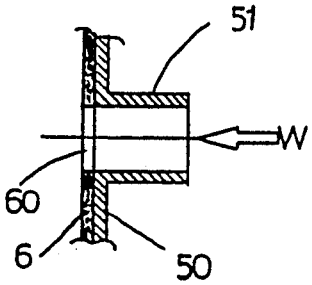
FIG. 25 is a sectional view of the inlet pipe of the mask.
Figure 24:
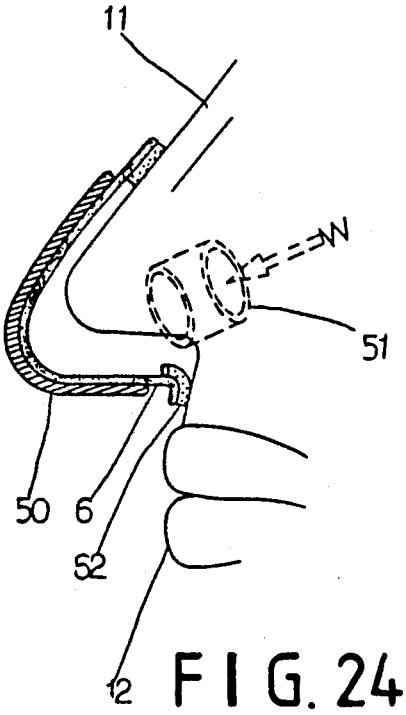
FIG. 24 shows how the mask is adapted to the nose of the user.
Figure 26:
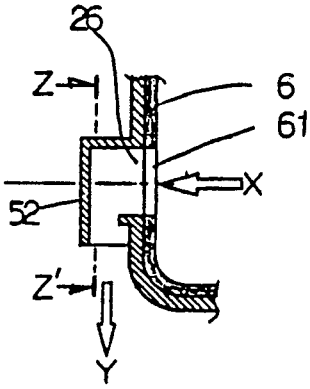
FIG. 26 is a sectional view of the outlet pipe of the mask.
Figure 27:
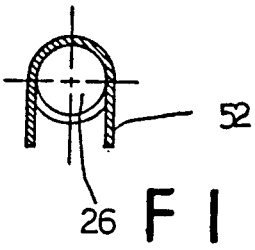
FIG. 27 is a sectional view taken along line Z—Z of FIG. 26.

Referring to FIGS. 14 through 21, the resilient clip 2 is used to keep the filter 3 in position and may be provided with a layer of sponge 22 (see FIG. 19). In addition, the resilient clip 2 may be engaged with the filter 3 at an angle of 90 degrees. As illustrated in FIGS. 14 through 18, the resilient clip 2 has a recess in which are received a spring 230 and a knob 23. The filter 3 is fixedly installed on hole 231 of the resilient clip 2 by engaging the knob 23 with the hole 306 of the filter 3. Additionally, the spring 230 will force the filter 3 tightly on the resilient clip 2. When desired to change it to another position, simply pull the resilient clip 2 slightly outwards (see FIG. 17) to detach from the protuberances 305 of the filter. Then, turn the resilient clip 2 through an angle of 180 degrees and engage it with protuberances 305 of the filter.

As illustrated in FIGS. 18 through 21, the elastic band 21 is riveted or otherwise secured to the lower corner of the filter, while the other elastic band 26 is mounted on the rotating member 250 by same means. Then, a screw 25 extends through a hole 251 of the rotating member 250 to engage with a hole 252 of the resilient clip 2.

Looking now at FIGS. 19 through 27, the mask 5 is provided with an inlet pipe 51, an exhaust pipe 52, a rigid body portion 50, and an inner soft mask 6. The soft mask 6 has an inlet 60 and an outlet 61 and is further provided with a sponge pad 62.

When in use (see FIGS. 1, 23–27, 28 and 29), simply turn on the switch 8 to suck in air. Then, the air will be filtered, cleaned and transmitted to the nose 11 of the user through the flexible pipe 4 and the inlet pipe 51. The surplus air will out of the mask 5 through the exhaust pipe 52 and the outlet pipe 61. Further, as the user exhales air from the lungs, the exhaled air will be exhausted out of the mask 5 by the filtered air. Besides, the flow rate of the air through the present invention may be adjusted as desired by a regulator.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A nose mask with a filtering device comprising:

a resilient clamp adapted to be worn on a head of an user;

a mask adapted to a nose of said user and having an inlet pipe and an exhaust pipe, said mask being provided with a soft pad at an inner side thereof;

a filter connected with one side of said resilient clamp and including a DC motor, a crank shaft driven by said DC motor, a diaphragm disposed under said crank shaft, a crank arm connecting said crank shaft and said diaphragm, a lower fixing plate installed under said diaphragm and on which are mounted two one-way exhaust valves, one of said exhaust valve being openable in one direction while another one of said exhaust valves being openable in an opposite direction, a filtering layer disposed under one of said exhaust valves, said filter having an outlet connected with the inlet pipe of said mask via a flexible pipe and an inlet through which air may be sucked in from outside;

said resilient clamp being able to be turned through an angle of 180 degrees with respect to said filter;

whereby when in use, air will be filtered and transmitted to the mask through the flexible pipe and the inlet pipe thereby enabling the user to inhale cleaned air while air exhaled by the user will be exhausted out of the exhaust pipe of said mask.

* * * * *